US009424743B2

(12) United States Patent
Banerjee et al.

(10) Patent No.: US 9,424,743 B2
(45) Date of Patent: Aug. 23, 2016

(54) REAL-TIME TRAFFIC DETECTION

(71) Applicant: TATA CONSULTANCY SERVICES LIMITED, Mumbai, Maharashtra (IN)

(72) Inventors: Rohan Banerjee, West Bengal (IN); Aniruddha Sinha, West Bengal (IN)

(73) Assignee: TATA CONSULTANCY SERVICES LIMITED, Mumbai (IN)

( * ) Notice: Subject to any disclaimer, the term of this patent is extended or adjusted under 35 U.S.C. 154(b) by 0 days.

(21) Appl. No.: 14/431,053

(22) PCT Filed: Oct. 10, 2013

(86) PCT No.: PCT/IN2013/000615

§ 371 (c)(1),
(2) Date: Mar. 25, 2015

(87) PCT Pub. No.: WO2014/057501

PCT Pub. Date: Apr. 17, 2014

(65) Prior Publication Data

US 2015/0248834 A1 Sep. 3, 2015

(30) Foreign Application Priority Data

Oct. 12, 2012 (IN) ..... 3005/MUM/2012

(51) Int. Cl.
*G08G 1/01* (2006.01)
*G08G 1/04* (2006.01)

(52) U.S. Cl.
CPC ..... *G08G 1/01* (2013.01); *G08G 1/0104* (2013.01); *G08G 1/0133* (2013.01); *G08G 1/04* (2013.01)

(58) Field of Classification Search
CPC ..... G08G 1/01; G08G 1/0133; G08G 1/0104; G08G 1/0141; G08G 5/0082
See application file for complete search history.

(56) References Cited

U.S. PATENT DOCUMENTS

| | | | | |
|---|---|---|---|---|
| 5,878,367 | A | 3/1999 | Lee et al. | |
| 6,418,371 | B1 | 7/2002 | Arnold | |
| 2009/0115635 | A1 * | 5/2009 | Berger | G01H 3/08 340/943 |
| 2012/0188102 | A1 * | 7/2012 | Kalyanaraman | G08G 1/0116 340/937 |

* cited by examiner

*Primary Examiner* — Curtis Odom
(74) *Attorney, Agent, or Firm* — Drinker Biddle & Reath LLP

(57) ABSTRACT

Systems and methods for real-time traffic detection are described. In one embodiment, the method comprises capturing ambient sounds as an audio sample in a user device, and segmenting the audio sample into a plurality of audio frames. Further, the method comprises identifying periodic frames amongst the plurality of audio frames. Spectral features of the identified periodic frames are extracted, and horn sounds are identified based on the spectral features. The identified horn sounds are then used for real-time traffic detection.

13 Claims, 5 Drawing Sheets

300

| AUDIO SAMPLE | TOTAL AUDIO FRAMES | TIME TAKEN FOR FEATURES EXTRACTION (SEC) | FEATURES SIZE (KB) | TOTAL PROCESSING TIME (SEC) |
|---|---|---|---|---|
| 1 | 7315 | 710 | 1141 | 710 |
| 2 | 7927 | 793 | 1236 | 793 |
| 3 | 24515 | 2431 | 3824 | 2431 |

302

| AUDIO SAMPLE | TOTAL AUDIO FRAMES | TIME TAKEN FOR IDENDIFYING PERIODIC FRAMES (SEC) | NO. OF PERIODIC FRAMES IDENTIFIED | TIME TAKEN FOR FEATURES EXTRACTION (SEC) | FEATURES SIZE (KB) | TOTAL PROCESSING TIME (SEC) |
|---|---|---|---|---|---|---|
| 1 | 7315 | 27 | 3490 | 315 | 544 | 378 |
| 2 | 7927 | 29 | 3516 | 362 | 548 | 391 |
| 3 | 24515 | 62 | 17796 | 1829 | 2776 | 1891 |

Fig. 3

REAL-TIME TRAFFIC DETECTION

TECHNICAL FIELD

The present subject matter relates, in general, to traffic detection and, in particular, to systems and methods for real-time traffic detection.

BACKGROUND

Traffic congestion is an ever increasing problem, particularly, in urban areas. Since the urban areas are usually populated, it has become difficult to travel without incurring delays due to traffic congestion, accidents, and other problems. It has become necessary to monitor the traffic congestion in order to provide travelers with accurate and real-time traffic information to avoid problems.

Several traffic detection systems have been developed in the past few years for detecting the traffic congestion. Such traffic detection systems include a system comprising a plurality of user devices, such as mobile phones and smart phones communicating with a central server, such as a back-end server, through a network for detecting the traffic congestion at various geographical locations. The user devices capture ambient sounds, i.e., the sounds present in an environment surrounding the user devices, which is processed for traffic detection. In some of the traffic detection systems, processing is entirely carried out at the user devices, and the processed data is sent to the central server for traffic detection. While in other traffic detection systems, the processing is entirely carried out by the central server for traffic detection. Thus, the processing overhead increases on a single entity, i.e., either on the user device or the central server, thereby leading to slow response time, and delay in providing the traffic information to the users.

SUMMARY

This summary is provided to introduce concepts related to real-time traffic detection. These concepts are further described below in the detailed description. This summary is not intended to identify essential features of the claimed subject matter nor is it intended for use in determining or limiting the scope of the claimed subject matter.

Systems and methods for real-time traffic detection are described. In one embodiment, the method comprises capturing ambient sounds as an audio sample, and segmenting the audio sample into a plurality of audio frames. Further, the method comprises identifying periodic frames amongst the plurality of audio frames. Spectral features of the identified periodic frames are extracted, and horn sounds are identified based on the spectral features. The identified horn sounds are then used for real-time traffic detection.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components.

FIG. 3 illustrates an exemplary tabular representations depicting comparison of total time taken for detecting the traffic congestion by the present traffic detection system and a conventional traffic detection system.

DETAILED DESCRIPTION

Figure 1:
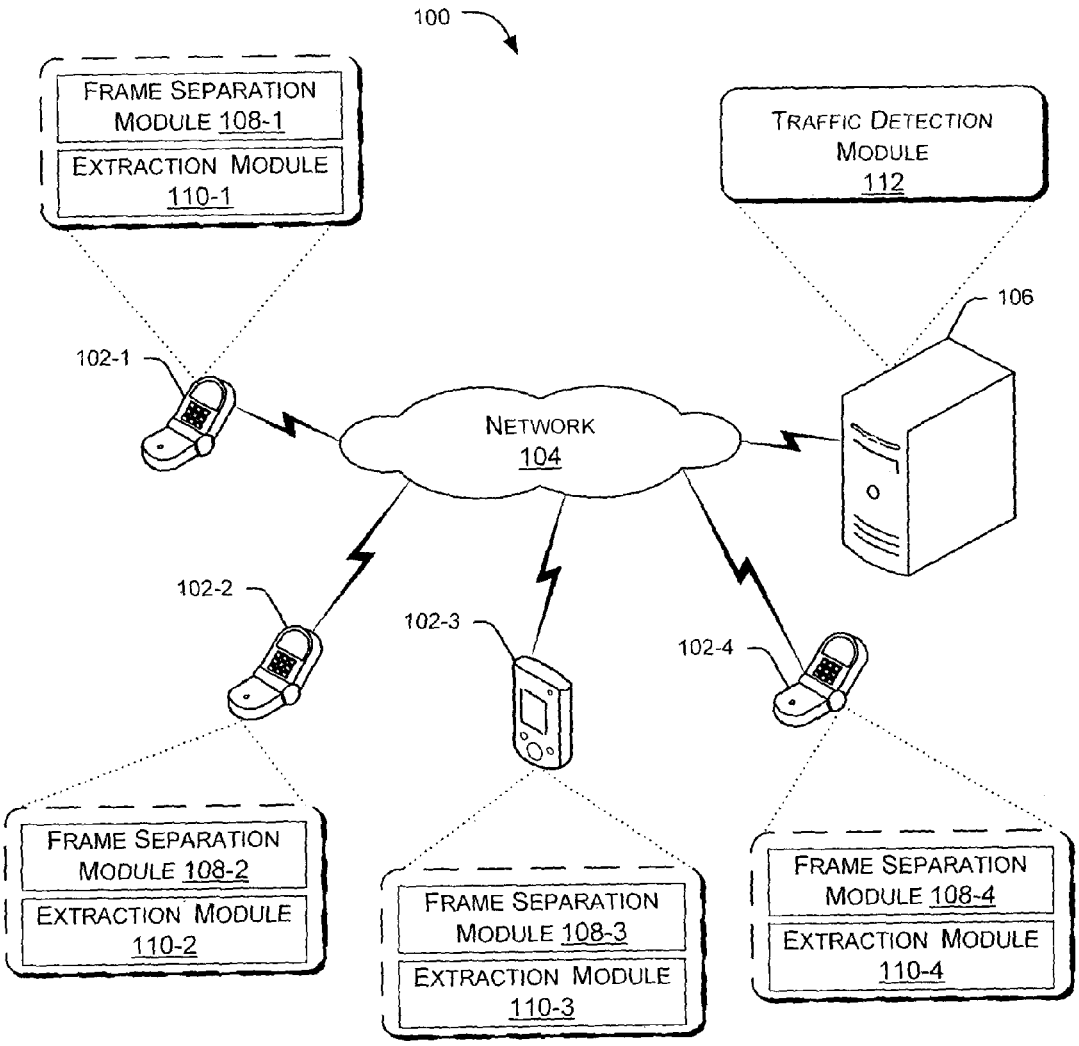
FIG. 1 illustrates a traffic detection system, in accordance with an embodiment of the present subject matter.

Conventionally, various sound based traffic detection systems are available for detecting traffic congestion at various geographical locations, and providing traffic information to users in order avoid problems due to the traffic congestion. Such sound based traffic detection systems capture ambient sounds, which is processed for traffic detection. The processing of the ambient sounds typically involves extracting spectral features of the ambient sounds, determining level, i.e., pitch or volume, of the ambient sounds based on the spectral features, and comparing the detected level with a predefined threshold to detect the traffic congestion. For example, when the comparison indicates that the detected levels of the ambient sounds are above the predefined threshold, the traffic congestion at the geographical location of the user device is detected and traffic information is provided to the users, such as travelers.

Such conventional traffic detection systems, however, suffers from numerous drawbacks. The processing of the ambient sounds in the conventional traffic detection systems is typically carried out either by the user devices or the central server. In both the cases, the processing overhead increases on a single entity, i.e., the user device or the central server, thereby leading to slow response time. Because of the slow response time, there is a time delay in providing the traffic information to the users. The conventional systems, therefore, fail to provide real-time traffic information to the users. Moreover, when the entire processing is carried out at the user devices, battery consumption of the user devices increases tremendously, posing difficulties to the users.

Further, the conventional traffic detection systems rely on the pitch or volume, of the ambient sounds for detecting the traffic congestion. However, the ambient sounds are usually a mixture of different types of sounds including human speech, environmental noise, vehicle's engine noise, music being played in vehicles, horn sounds, etc. Taking a scenario, where a pitch of the human speech and music being played in the vehicles is too high, and the user devices placed in the vehicles captures these ambient sounds containing high volume of human speech and music along with the other sounds. In such a scenario, if the level of these ambient sounds is identified as higher than the predefined threshold, traffic congestion is detected falsely and the false traffic information is provided to the users. Thus, these conventional traffic detection systems fail to provide reliable traffic information.

In accordance with the present subject matter, systems and methods for detecting real time traffic congestion are described. In one embodiment, the traffic detection system comprises a plurality of user devices and a central server (hereinafter referred to as server). The user devices communicate with the server through a network for real-time traffic detection. The user devices referred herein may include, but are not restricted to, communication devices, such as mobile phones and smart phones, or computing devices, such as Personal Digital Assistants (PDA) and laptops.

In one implementation, the user devices capture ambient sounds, i.e., the sounds present in an environment surrounding the user devices. The ambient sounds may include, for example, tire noise, music being played in vehicle(s), human speech, horn sound, and engine noise. Additionally, the ambient sounds may contain background noise including environmental noise and background traffic noise. The ambient sounds are captured as an audio sample of short time duration, say, few minutes. The audio sample, thus, captured by the user devices can be stored within a local memory of the user devices.

The audio sample is then processed partly by the user devices and partly by the server to detect the traffic congestion. At the user device end, the audio sample is segmented into a plurality of audio frames. Subsequent to the segmentation, background noise is filtered from the plurality of audio frames. The background noise may affect the sound which produces peaks of high frequency. Therefore, the background noise is filtered from the plurality of audio frames to generate a plurality of filtered audio frames. The plurality of filtered audio frames may be stored in the local memory of the user devices.

Once the plurality of audio frames is filtered, the audio frames are separated into three types of frames, i.e., periodic frames, non-periodic frames, and silenced frames. The periodic frames may include a mixture of horn sound and human speech, and the non-periodic frames may include a mixture of tire noise, music played in the vehicle(s), and engine noise. The silenced frames, does not include any kind of sound.

Out of the above mentioned three types of frames, the periodic frames are then picked up for further processing. To pick up or identify the periodic frames, the non-periodic frames and the silenced frames are rejected based on the Power Spectral Density (PSD) and short term energy level (En) of the audio frames respectively.

In one implementation, spectral features of the identified periodic frames are extracted by the user device. The spectral features used in this application are disclosed in co-pending Indian Patent Application No. 462/MUM/2012, which is incorporated herein by reference. The spectral features referred herein may include, but not limited to, one or more of Mel-Frequency Cepstral Coefficients (MFCC), inverse Mel-Frequency Cepstral Coefficients (inverse MFCC), and modified Mel-Frequency Cepstral Coefficients (modified MFCC). Since, the periodic frames include, mixture of the horn sound and the human speech, the extracted spectral features corresponds to the features of both the horn sound and the human speech. The extracted spectral features are then transmitted to the server, via the network, for traffic detection.

At the server end, the spectral features are received from the plurality of user devices at a particular geographical location. Based on the spectral features, the horn sound and the human speech is segregated using one or more known sound models. In one implementation, the sound models include a horn sound model and a traffic sound model. The horn sound model is configured to detect only the horn sound, while the traffic sound model is configured to detect different type of traffic sounds other than the horn sounds. Based on the segregation, level or rate of the horn sounds is compared with a predefined threshold, to detect the traffic congestion at the geographical location, and real-time traffic information is subsequently provided to the users, via, the network.

In one implementation, the user devices are capable of operating in an online mode as well as an offline mode. For example, in the online mode, the user devices can be connected to the server, via, the network during the complete processing. While, in the offline mode, the user devices are capable of performing the in-part processing, without being connected to the server. In order to communicate with the server for further processing, the user devices can be switched to the online mode, and the server will carry out rest of the processing to detect traffic.

According to the systems and the methods of the present subject matter, processing load on the user devices and the server is segregated. Thus, real-time traffic detection is achieved. Moreover, only the required audio frames, i.e., the periodic frames, are taken up for processing, unlike the prior art where the entire audio frames are processed containing additional noises that may lead to erroneous traffic detection, and circulation of false traffic information to the users. Thus, the systems and the methods of the present subject matter provide reliable traffic information to the users. Also, processing of only required audio frames by the user devices further reduces processing load and processing time, thereby reducing battery consumption.

The following disclosure describes system and method of real-time traffic detection. While aspects of the described system and method may be implemented in any number of different computing systems, environments, and/or configurations, embodiments are described in the context of the following exemplary system architecture(s).

FIG. 1 illustrates a traffic detection system 100, in accordance with an embodiment of the present subject matter. In one implementation, the traffic detection system 100 (hereinafter referred to as system 100) comprises a plurality of user devices 102-1, 102-2, 102-3, . . . 102-N are connected, through a network 104, to a server 106. The user devices 102-1, 102-2, 102-3, . . . 102-N are collectively referred to as the user devices 102 and individually referred to as a user device 102. The user devices 102 may be implemented as any of a variety of conventional communication devices, including, for example, mobile phones and smart phones, and/or conventional computing devices, such as Personal Digital Assistants (PDAs) and laptops.

The user devices 102 are connected to the server 106 over the network 104 through one or more communication links. The communication links between the user devices 102 and the server 106 are enabled through a desired form of communication, for example, via dial-up modem connections, cable links, digital subscriber lines (DSL), wireless or satellite links, or any other suitable form of communication.

The network 104 may be a wireless network. In one implementation, the network 104 can be an individual network, or a collection of many such individual networks, interconnected with each other and functioning as a single large network, e.g., the Internet or an intranet. Examples of the individual networks include, but are not limited to, Global System for Mobile Communication (GSM) network, Universal Mobile Telecommunications System (UMTS) network, Personal Communications Service (PCS) network, Time Division Multiple Access (TDMA) network, Code Division Multiple Access (CDMA) network, Next Generation Network (NGN), and Integrated Services Digital Network (ISDN). Depending on the technology, the network 104 may include various network entities, such as gateways, routers, network switches, and hubs, however, such details have been omitted for ease of understanding.

In an implementation, each of the user devices 102 includes a frame separation module 108 and an extraction module 110. For example, the user device 102-1 includes a frame separation module 108-1 and the extraction module 110-1, and the user device 102-2 includes a frame separation module 108-2 and the extraction module 110-2, and so on. The server 106 includes a traffic detection module 112.

In one implementation, the user devices 102 capture ambient sounds. The ambient sounds may include tire noise, music played in vehicles, human speech, horn sound, and engine noise. The ambient sounds may also contain background noise including environmental noise and background traffic noise. The ambient sounds are captured as an audio sample, for example, an audio sample of short time duration, say, few minutes. The audio sample may be stored within a local memory of the user device 102.

The user device 102 segments the audio sample into a plurality of audio frames and then filters the background noise from the plurality of audio frames. In one implementation, the filtered audio frames may be stored within the local memory of the user device 102.

Subsequent to the filtration, the frame separation module 108 separates the filtered audio frames into periodic frames, non-periodic, and silenced frames. The periodic frames may include a mixture of horn sound and human speech, and the non-periodic frames may include a mixture of tire noise, music played in the vehicle(s), and engine noise. The silenced frames, does not include any kind of sound. Based on the separation, the frame separation module 108 identifies the periodic frames.

The extraction module 110 within the user device 102 then extracts spectral features of the periodic frames, such as one or more of Mel-Frequency Cepstral Coefficients (MFCC), inverse Mel-Frequency Cepstral Coefficients (inverse MFCC), and modified Mel-Frequency Cepstral Coefficients (modified MFCC), and transmits the extracted spectral features to the server 106. As indicated previously, the periodic frames include mixture of the horn sound and the human speech, the extracted spectral features, thus, corresponds to the features of both the horn sound and the human speech. In one implementation, the extracted spectral features can be stored within the local memory of the user device 102. Upon receiving the extracted spectral features from a plurality of user devices 102 at a geographical location, the server 106 segregates the horn sound and human speech based on known sound models. Based on the horn sound, the traffic detection module 112 within the server 106 detects the real-time traffic at the geographical location.

Figure 2:
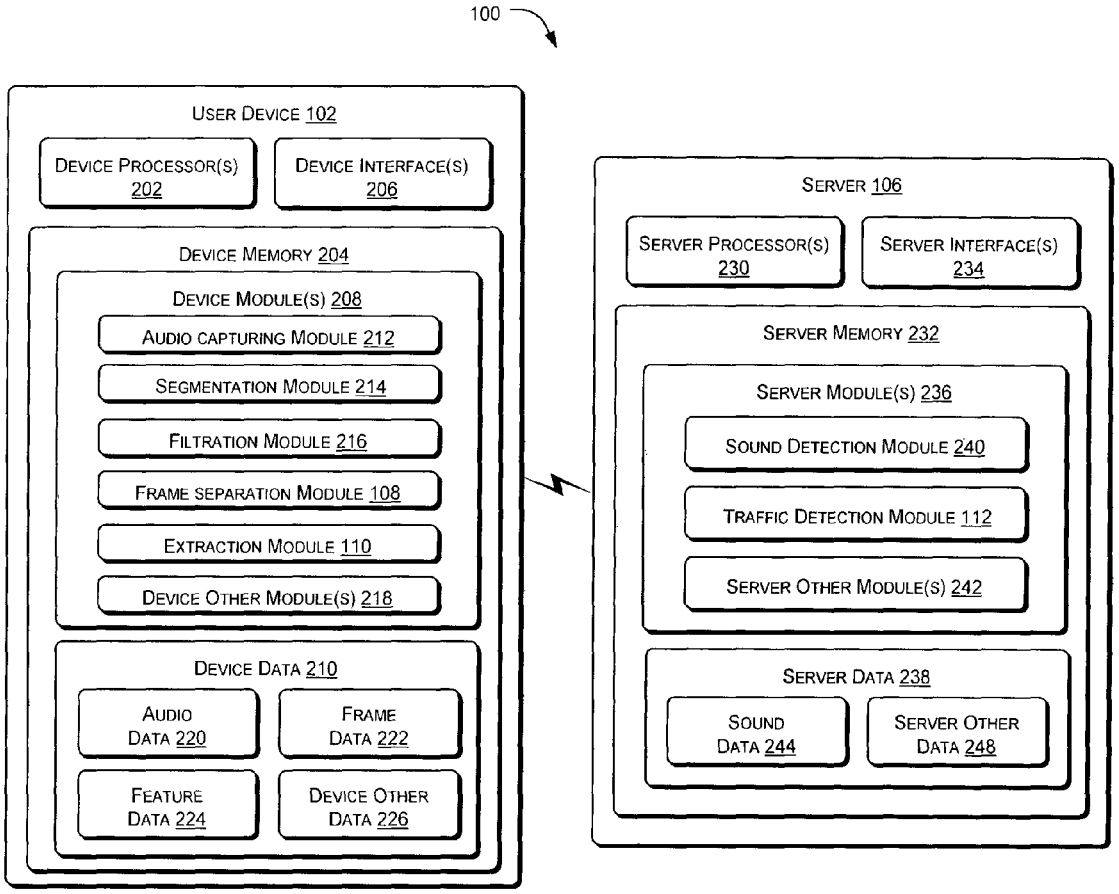
FIG. 2 illustrates details of the traffic detection system, according to an embodiment of the present subject matter.

FIG. 2 illustrates details of traffic detection system 100, according to an embodiment of the present subject matter.

In said embodiment, the traffic detection system 100 may include a user device 102 and a server 106. The user device 102 includes one or more device processor(s) 202, a device memory 204 coupled to the device processor 202, and device interface(s) 206. The server 106 includes one or more server processor(s) 230, a server memory 232 coupled to the server processor 230, and server interface(s) 234.

The device processor 202 and the server processor 230 can be a single processing unit or a number of units, all of which could include multiple computing units. The device processor 202 and the server processor 230 may be implemented as one or more microprocessors, microcomputers, microcontrollers, digital signal processors, central processing units, state machines, logic circuitries, and/or any devices that manipulate signals based on operational instructions. Among other capabilities, the device processor 202 and the server processor 230 are configured to fetch and execute computer-readable instructions and data stored in the device memory 204 and the server memory 232 respectively.

The device interfaces 206 and the server interfaces 234 may include a variety of software and hardware interfaces, for example, interface for peripheral device(s), such as a keyboard, a mouse, an external memory, a printer, etc. Further, the device interfaces 206 and the server interfaces 234 may enable the user device 102 and the server 106 to communicate with other computing devices, such as web servers and external databases. The device interfaces 206 and the server interfaces 234 may facilitate multiple communications within a wide variety of protocols and networks, such as a network including wireless networks, e.g., WLAN, cellular, satellite, etc. The device interfaces 206 and the server interfaces 234 may include one or more ports to allow communication between the user device 102 and the server 106.

The device memory 204 and the server memory 232 may include any computer-readable medium known in the art including, for example, volatile memory such as static random access memory (SRAM) and dynamic random access memory (DRAM), and/or non-volatile memory, such as read only memory (ROM), erasable programmable ROM, flash memories, hard disks, optical disks, and magnetic tapes. The device memory 204 further includes device module(s) 208 and device data 210, and the server memory 232 further includes server module(s) 236 and server data 238.

The device modules 208 and the server modules 236 include routines, programs, objects, components, data structures, etc., which perform particular tasks or implement particular abstract data types. In one implementation, the device module(s) 208 include an audio capturing module 212, a segmentation module 214, a filtration module 216, the frame separation module 108, the extraction module 110, and device other module(s) 218. In said implementation, the server module(s) 236 include a sound detection module 240, the traffic detection module 112, and the server other module(s) 242. The device other module(s) 218 and the server other module(s) 242 may include programs or coded instructions that supplement applications and functions, for example, programs in the operating system of the user device 102 and the server 106 respectively.

The device data 210 and the server data 238, amongst other things, serves as repositories for storing data processed, received, and generated by one or more of the device module(s) 208 and the server module(s) 236. The device data 210 includes audio data 220, frame data 222, feature data 224, and device other data 226. The server data 238 includes sound data 244 and server other data 248. The device other data 226 and the server other data 248 includes data generated as a result of the execution of one or more modules in the device other module(s) 218 and the server other modules 242.

In operation, the audio capturing module 212 of the user device 102 captures ambient sounds, i.e., the sounds present in an environment surrounding the user device 102. Such ambient sounds may include tire noise, music played in vehicles, human speech, horn sound, engine noise. Additionally, the ambient noise includes background noise containing environmental noise, and background traffic noise. The ambient sounds may be captured as an audio sample either continuously or at predefined time intervals, say, after every 10 minutes. Time duration of the audio sample captured by the user device 102 may be short, say, few minutes. In one implementation, the captured audio sample may be stored in a local memory of the user device 102, as the audio data 220, which can be retrieved when required.

In one implementation, the segmentation module 214 of the user device 102 retrieves the audio sample, and segments the audio sample into a plurality of audio frames. In one example, the segmentation module 214 segments the audio sample using a conventionally known hamming window segmentation technique. In the hamming window segmentation technique, a hamming window of a predefined duration, for example, 100 ms is defined. As an instance, if the audio sample of about 12 minutes of time duration is segmented with a hamming window of 100 ms, then the audio sample is segmented into about 7315 audio frames.

In one implementation, the segmented audio frames, thus, obtained are provided as an input to the filtration module 216, which is configured to filter the background noise from the plurality of audio frames, as the background noise may affect that sound which produces peaks of high frequency. For example, the horn sounds that are considered to produce peaks of high frequency are susceptible to the background noise. Therefore, the filtration module 216 filters the background noise, to boost up such kind of sounds. The audio frames, thus, generated as a result of the filtration is hereinafter referred to as filtered audio frames. In one implementation, the filtration module 216 may store the filtered audio frames as the frame data 222 with the local memory of the user device 102.

The frame separation module 108 of the user device 102 is configured to segregate the audio frames or the filtered audio frames into periodic frames, non-periodic frames, and silenced frames. The periodic frames may be a mixture of horn sound and human speech, and the non-periodic frames may be a mixture of tire noise, music played in the vehicles, and the engine noise. The silenced frames are the frames without any sound, i.e., soundless frames. For segregation, the frame separation module 108 computes short term energy level (En) of each of the audio frames or the filtered audio frames, and compares the computed short term energy level (En) to a predefined energy threshold ($En_{Th}$). The audio frames having the short term energy level (En) less than the energy threshold ($En_{Th}$) are rejected as the silenced frames and the remaining audio frames are further examined to identify the periodic frames amongst them. For example, if the total number of filtered audio frames is about 7315, the energy threshold ($En_{Th}$) is 1.2 and the number of filtered audio frames with short term energy level (En) less than 1.2 is 700. In said example, the 700 filtered audio frames are rejected as silenced frames and the remaining 6615 filtered audio frames are further examined to identify the periodic frames amongst them.

The frame separation module 108 calculates total power spectral density (PSD) of the remaining audio frames, and maximum PSD of a filtered audio frame. The total PSD of remaining filtered audio frames taken together is denoted as $PSD_{Total}$ and the maximum PSD of the filtered audio frame is denoted as $PSD_{Max}$ to identify the periodic frames amongst the plurality of filtered audio frames. According to one implementation, the frame separation module 108 identifies the periodic frames using the equation (1) provided below:

$$r = \frac{PSD_{Max}}{PSD_{Total}} \tag{1}$$

wherein, $PSD_{Max}$ represents the maximum PSD of a filtered audio frame, $PSD_{Total}$ represents the total PSD of the filtered audio frames, and r represents the ratio of the $PSD_{Max}$ to the $PSD_{Total}$.

The ratio as obtained by the above equation is then compared with the predefined density threshold ($PSD_{Th}$) by the frame separation module 108 to identify the periodic frames. For example, an audio frame is identified to be periodic, if the ratio is greater than the density threshold ($PSD_{Th}$). While, the audio frame is rejected if the ratio is lesser than the density threshold ($PSD_{Th}$). Such a comparison is carried out separately for each of the filtered frames to identify all the periodic frames.

Once the periodic frames are identified, the extraction module 110 of the user device 102 is configured to extract spectral features of the identified periodic frames. The extracted spectral features may include one or more of Mel-Frequency Cepstral Coefficients (MFCC), inverse Mel-Frequency Cepstral Coefficients (inverse MFCC), and modified Mel-Frequency Cepstral Coefficients (modified MFCC). In one implementation, the extraction module 110 extracts the spectral features based on conventionally known feature extraction techniques. As indicated earlier, the periodic frames include a mixture of horn sound and the human speech, the extracted spectral features therefore corresponds to the horn sound and the human speech.

Subsequent to extraction of the spectral features, the extraction module 110 transmits the extracted spectral features to the server 106 for further processing. The extraction module 110 may store the extracted spectral features of the periodic frames as the feature data 244 in the local memory of the user device 102.

At the server end, the sound detection module 240 of the server 106 receives the extracted spectral features from multiple user devices 102 falling under a common geographical location, and segregates the collated spectral features into horn sounds and human speech. The sound detection module 240 performs the segregation based on conventionally available sound models including a horn sound model and a traffic sound model. The horn sound model is configured to identify the horn sounds, and the traffic sound model is configured to identify traffic sounds other than the horn sounds, for example, human speech, tire noise, and music played in the vehicles. The horn sound and the human speech have different spectral properties. For example, the human speech produces peaks in the range of 500-1500 KHz (Kilo Hertz) and the horn sound produce peaks above 2000 KHz (Kilo Hertz). When the spectral features are fed as an input to these sound models, the horn sounds are identified. The sound detection module 240 may store the identified horn sounds as sound data 224 in the server 106.

The traffic detection module 112 of the server 106 is then configured to detect the real-time traffic based on the identification of the horn sound. As the horn sounds represents rate of honking on the road, which is more when there is traffic congestion. The identified horn sounds are compared with predefined threshold by the traffic detection module 112 to detect traffic at the geographical location.

Thus, according to present subject matter for detecting the real-time traffic congestion, the periodic frames are separated from the audio sample and spectral features are extracted only for the periodic frames, thereby reducing the overall processing time and the battery consumption by the user devices 102. Also, since the extracted features of only the periodic frames are transmitted by the user devices 102 to the server 106, the load on the server is also reduced and thus, time taken by the server 106 to detect traffic is significantly reduced.

FIG. 3 illustrates an exemplary tabular representations depicting comparison of total time taken for detecting the traffic congestion by the present traffic detection system and a conventional traffic detection system.

As shown in the FIG. 3, the table 300 corresponds to the conventional traffic detection system and the table 302 corresponds to the present traffic detection system 100. As shown in the table 300, three audio samples, namely, a first audio sample, a second audio sample, and a third audio sample, are processed by the conventional traffic detection system for detecting the traffic congestion. Such audio samples are segmented into a plurality of audio frames, such that each audio frame is of a time duration 100 ms. For example, the first audio sample is segmented into 7315 audio frames of duration 100 ms. Likewise, the second audio sample is segmented into 7927 audio frames, and the third audio sample is segmented into 24515 audio frames. Further, spectral features are extracted for all the three audio frames. The total processing time taken by the conventional traffic detection system for the processing, especially, the spectral feature extraction of three audio samples are 710 sec, 793 sec, and 2431 sec respectively and corresponding size of extracted spectral features is 1141 KB, 1236 KB, and 3824 KB respectively.

On the other hand, the present traffic detection system 100 also processed the same three audio samples as shown in the table 302. The audio samples are segmented into a plurality of audio frames, such as periodic frames, non-periodic frames and silenced frames. However, the present traffic detection system 100 picks up only the periodic frames for processing. The time taken to identify the periodic frames from the first audio sample, the second audio sample, and the third audio sample is 27 sec, 29 sec, and 62 sec respectively. The spectral features are then extracted for the identified periodic frames. Time taken by the present traffic detection system 100 to extract the spectral features of the periodic frames is 351 sec, 362 sec, and 1829 sec, for the first audio sample, the second audio sample, and the third audio sample respectively, and the corresponding size of extracted spectral features is 544 KB, 548 KB, and 2776 KB. Therefore, total processing time taken by the present traffic detection system 100 for processing the first audio sample, the second audio sample, and the third audio sample is 378 sec, 391 sec, and 1891 sec.

It is clear from the table 300 and the table 302 that the total time taken by the present traffic detection system 100 for processing of the audio samples is significantly less than the total processing time taken by the conventional traffic detection system. Such a reduction in the processing time is achieved due to separation of frames into periodic, non-periodic, and silenced frames, and processing only the periodic frames for spectral features extraction unlike the conventional traffic detection systems where all the frames were taken into consideration.

Figure 4A:
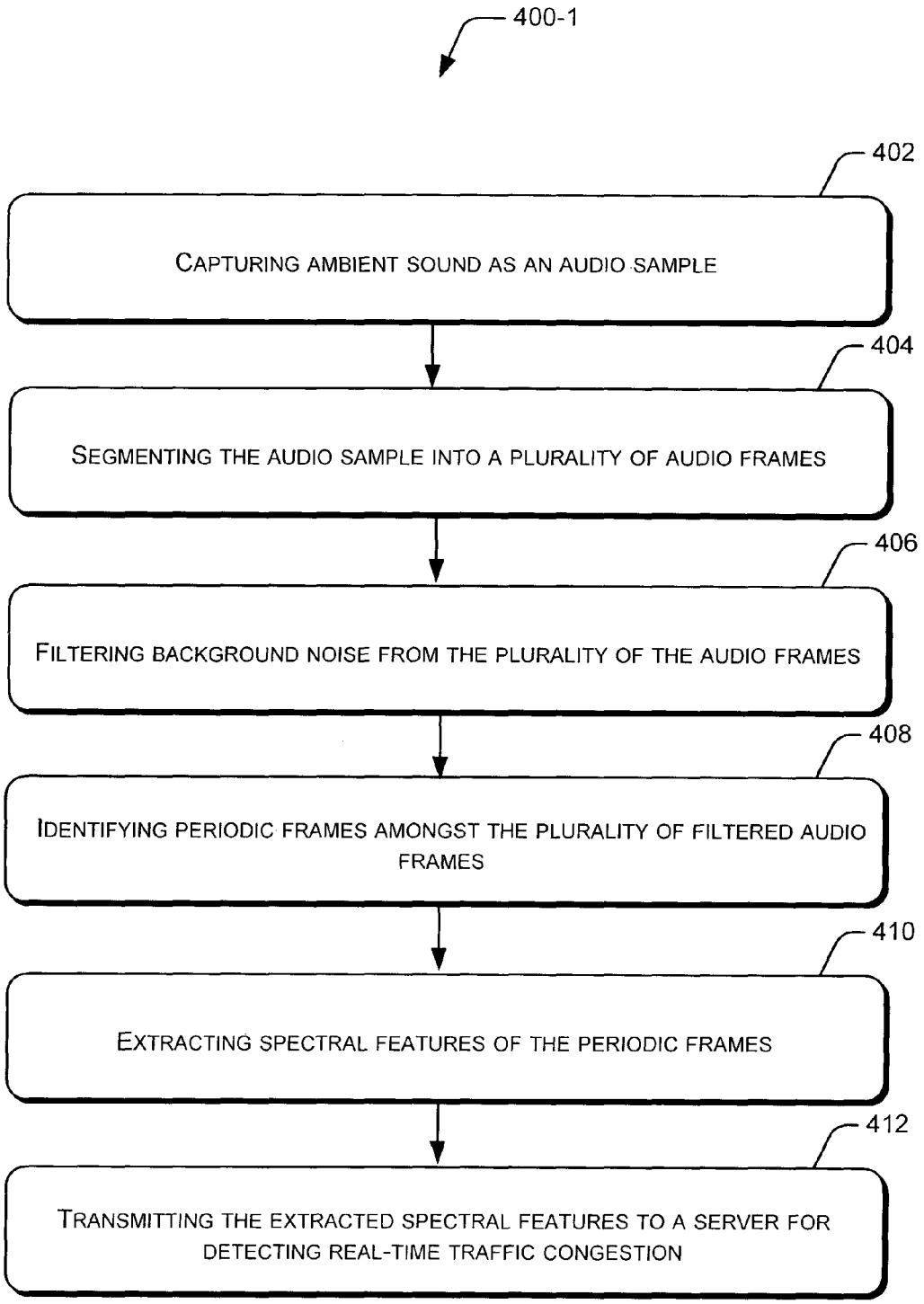
FIGS. 4*a* and 4*b* illustrate a method for real-time traffic detection, in accordance to another embodiment of the present subject matter.
Figure 4B:
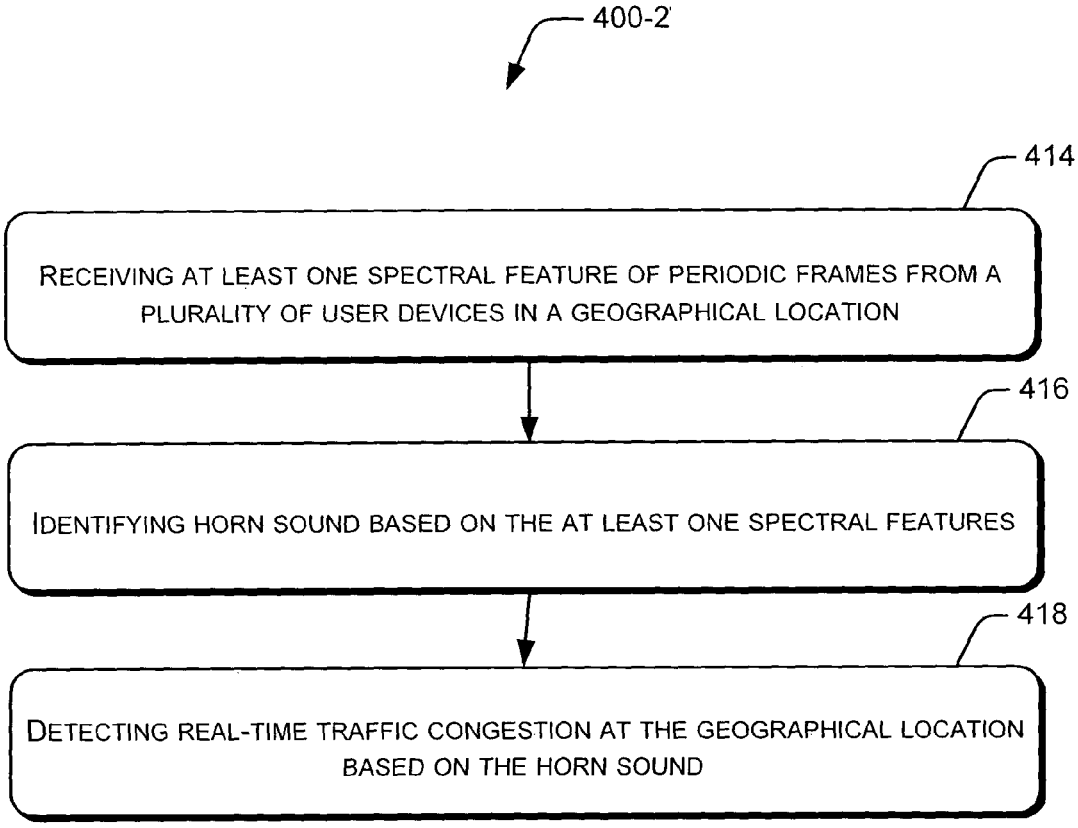

FIGS. 4*a* and 4*b* illustrate a method 400 for real-time traffic detection, in accordance with an embodiment of the present subject matter. Specifically, the FIG. 4*a* illustrates a method 400-1 for extracting the spectral features from an audio sample, and the FIG. 4*b* illustrates a method 400-2 for detection of real-time traffic congestion based on the spectral features. The methods 400-1 and 400-2 are collectively referred to as the methods 400.

The methods 400 may be described in the general context of computer executable instructions. Generally, computer executable instructions can include routines, programs, objects, components, data structures, procedures, modules, functions, etc., that perform particular functions or implement particular abstract data types. The methods 400 may also be practiced in a distributed computing environment where functions are performed by remote processing devices that are linked through a communications network. In a distributed computing environment, computer executable instructions may be located in both local and remote computer storage media, including memory storage devices.

The order in which the methods 400 are described is not intended to be construed as a limitation, and any number of the described method blocks can be combined in any order to implement the methods 400, or alternative methods. Additionally, individual blocks may be deleted from the methods without departing from the spirit and scope of the subject matter described herein. Furthermore, the methods 400 can be implemented in any suitable hardware, software, firmware, or combination thereof.

Referring to FIG. 4*a*, at block 402, the method 400-1 includes capturing ambient sounds. The ambient sounds include tire noise, music played in vehicle(s), human speech, horn sound, and engine noise. Further, the ambient sounds may include background noise containing environmental noise and background traffic noise. In one implementation, the audio capturing module 212 of the user device 102 captures ambient sounds as an audio sample.

At block 404, the method 400-1 includes segmenting the audio sample into plurality of audio frames. The audio sample is segmented into the plurality of audio frames using a hamming window segmentation technique. The hamming window is a predefined duration window. In one implementation, the segmentation module 214 of the user device 102 segments the audio sample into a plurality of audio frames.

At block 406, the method 400-1 includes filtering background noise from the plurality of audio frames. Since the background noise affects the sounds producing peaks of high frequency, the background noise is filtered from the audio frames. In one implementation, the filtration module 216 filters the background noise from the plurality of audio frames. The audio frames obtained as a result of filtration are referred to as filtered audio frames.

At block 408, the method 400-1 includes identifying the periodic frames amongst the plurality of filtered audio frames. In one implementation, the frame separation module 108 of the user device 102 is configured to segregate the plurality of audio frames into periodic frames, non-periodic frames, and silenced frames. The periodic frames may include a mixture of horn sound and human speech, and the non-periodic frames may include a mixture of tire noise, music played in the vehicle(s), and engine noise. The silenced frames, does not include any kind of sound. Based on the segregation, the frame separation module 108 identifies the periodic frames for further processing.

At block 410, the method 400-1 includes extracting the spectral features of the periodic frames. The extracted spectral features may include one or more of Mel-Frequency Cepstral Coefficients (MFCC), inverse Mel-Frequency Cepstral Coefficients (inverse MFCC), and modified Mel-Frequency Cepstral Coefficients (modified MFCC). As indicated earlier, the periodic frames include a mixture of horn sound and human speech, thus, the extracted spectral features corresponds to the horn sound and the human speech. In one implementation, the extraction module 110 is configured to extract spectral features of the identified periodic frames.

At block 412, the method 400-1 includes transmitting the extracted spectral features to the server 106 for detecting real-time traffic congestion. In one implementation, the extraction module 110 transmits the extracted spectral features to the server 106.

Referring to FIG. 4*b*, at block 414, the method 400-2 includes receiving the spectral features from a plurality of user devices 102 in a geographical location, via, the network 104. In one implementation, the sound detection module 240 of the server 106 receives the spectral features.

At block 416, the method 400-2 includes identifying the horn sound from the received spectral features. The horn sound is identified, for example, based on conventionally available sound models including the horn sound model and the traffic sound model. Based on these sound models, distinction between the horn sound and the human speech is made and the horn sound is therefore identified. In one implementation, the sound detection module 240 of the server 106 identifies the horn sound.

At block 418, the method 400-2 includes detecting real-time traffic congestion based on the horn sound identified at the previous block. The horn sound is indicative of rate of honking on the road, which is considered as a parameter for accurately detecting the traffic congestion in the present description. Based on comparing the rate of honking or the level of horn sounds with a predefined threshold value, the traffic detection module 112 detects the traffic congestion at the geographical location.

Although embodiments for the traffic detection system have been described in language specific to structural features and/or methods, it is to be understood that the invention is not necessarily limited to the specific features or methods described. Rather, the specific features and methods are disclosed as exemplary implementations for the traffic detection system.

We claim:

1. A method for real-time traffic detection, wherein the method comprising:

capturing ambient sounds as an audio sample in a user device;

segmenting the audio sample into a plurality of audio frames;

identifying periodic frames amongst the plurality of audio frames, wherein the identifying comprises separating the plurality of audio frames into the periodic frames, non-periodic frames, and silenced frames based on a short term energy level (En) and a Power Spectral Density (PSD) of the plurality of audio frames; and extracting spectral features of the periodic frames for real-time traffic detection.

2. The method as claimed in claim 1, wherein the ambient sounds include one or more of tire noise, horn sound, engine noise, human speech, and background noise.

3. The method as claimed in claim 1, wherein the separating comprises computing the short term energy level (En) for the plurality of audio frames; and comparing the short term energy level (En) of each of the plurality of audio frames with a predefined energy threshold to identify the silenced frames amongst the plurality of audio frames;

calculating a ratio of a maximum power spectral density and a total power spectral density (PSD) of remaining audio frames, wherein the remaining audio frames exclude the silenced frames; and identifying the periodic frames amongst the remaining audio frames based on comparing the ratio of the maximum power spectral density and the total power spectral density with a predefined density threshold.

4. The method as claimed in claim 1 further comprising filtering background noise from the plurality of audio frames.

5. The method as claimed in claim 1, wherein the spectral features include one or more of Mel-Frequency Cepstral Coefficients (MFCC), inverse MFCC, and modified MFCC.

6. A method for real-time traffic detection, wherein the method comprising:

receiving spectral features of periodic frames from a plurality of user devices in a geographical location, wherein the periodic frames are identified based on a short term energy level (En) and a Power Spectral Density (PSID) of the plurality of audio frames;

identifying horn sounds based on the spectral features; and detecting real-time traffic congestion at the geographical location based on the horn sounds.

7. The method as claimed in claim 6, wherein the spectral features include one or more of Mel-Frequency Cepstral Coefficients (MFCC), inverse MFCC, and modified MFCC.

8. The method as claimed in claim 6, wherein the identifying is based on at least one sound model, wherein the at least one sound model is any one of a horn sound model and a traffic sound model.

9. A user device for real-time traffic detection comprising:

a device processor; and a device memory coupled to the device processor, the device memory comprising:

a segmentation module configured to segment an audio sample captured in the user device into a plurality of audio frames;

a frame separation module configured to separate the plurality of audio frames into at least periodic frames and non-periodic frames, wherein the frame separation module is configured to separate the plurality of audio frames based on a short term energy level (En) and a Power Spectral Density (PSD) of the plurality of audio frames; and an extraction module configured to extract spectral features of the periodic frames, wherein the spectral features are transmitted to a server for real-time traffic detection.

10. The user device as claimed in claim 9, wherein the user device further comprising a filtration module configured to filter background noise from the plurality of audio frames.

11. A server for real-time traffic detection comprising:

a server processor; and a server memory coupled to the server processor, the server memory comprising:

a sound detection module configured to:

receive spectral features of periodic frames from a plurality of user devices in a geographical location, wherein the periodic frames are identified based on a short term energy level (En) and a Power Spectral Density (PSD) of the plurality of audio frames; and identify horn sounds based on the spectral features; and a traffic detection module configured to detect real-time traffic congestion at the geographical location based on the horn sounds.

12. The server as claimed in claim 11, wherein the sound detection module is configured to identify the horn sounds based on at least one of a horn sound model and a traffic sound model.

13. A non-transitory computer-readable medium having embodied thereon a computer program for executing a method comprising:

capturing ambient sounds as an audio sample;

segmenting the audio sample into a plurality of audio frames;

identifying periodic frames amongst the plurality of audio frames, wherein the identifying comprises separating the plurality of audio frames into the periodic frames, non-periodic frames, and silenced frames based on a short term energy level (En) and a Power Spectral Density (PSD) of the plurality of audio frames;

extracting spectral features of the periodic frames;

identifying horn sounds based on the spectral features; and detecting real-time traffic congestion based on the horn sounds.

* * * * *